US005335679A

United States Patent [19]

Baxter

[11] Patent Number: 5,335,679

[45] Date of Patent: Aug. 9, 1994

[54] DEVICE AND PROCESS FOR USE IN COLORING HAIR

[75] Inventor: Michael J. Baxter, Littleton, Colo.

[73] Assignee: Lightworks International Inc., Littleton, Colo.

[21] Appl. No.: 58,304

[22] Filed: May 10, 1993

[51] Int. Cl.[5] ..... A45D 19/18

[52] U.S. Cl. ..... 132/270; 132/208; 132/222

[58] Field of Search ..... 132/208, 222, 270

[56] References Cited

U.S. PATENT DOCUMENTS

| | | | |
|---|---|---|---|
| 2,151,024 | 3/1939 | Gilbert | 132/222 |
| 4,196,741 | 4/1980 | Minghenelli | 132/222 |
| 4,655,377 | 4/1987 | Oranego, Jr. et al. | 132/222 |
| 5,007,443 | 4/1991 | Fulgoni | 132/222 |
| 5,056,539 | 10/1991 | Abramson | 132/208 |
| 5,146,937 | 9/1992 | Lefebvre | 132/222 |
| 5,156,172 | 10/1992 | Tancredi | 132/222 |

FOREIGN PATENT DOCUMENTS

| | | | |
|---|---|---|---|
| 0126618 | 11/1984 | European Pat. Off. | 132/222 |
| 0136896 | 4/1985 | European Pat. Off. | 132/270 |
| 2096460 | 10/1992 | United Kingdom | 132/270 |

*Primary Examiner*—Gene Mancene
*Assistant Examiner*—Frank A. LaViola
*Attorney, Agent, or Firm*—Donald W. Margolis; Emory L. Tracy

[57] ABSTRACT

A thin strip of liquid-impermeable polymeric material has a strip of porous material secured to one of its surface to form a flexible sheet. A pressure sensitive adhesive element, which is more adherent to the porous material than to hair, is adhered to the other surface of the porous strip. The pressure sensitive adhesive element is used to attach the flexible sheet firmly, but releaseably, to the hair of the head of a person adjacent to the portion of hair which is to be treated. In using the sheet, a colorist places the first end of the sheet with the adhesive element on the hair and then presses on the liquid-impermeable surface to cause the adhesive element to firmly adhere it in place against the underlying hair. The colorist then weaves an amount of hair over the face of the liquid-impermeable surface, followed by the treatment of that hair with a wet hair treating agent. The colorist then bends one end of the liquid-impermeable surface into contact with the adhered end, and then presses the two ends together so that the flexible sheet forms, by hydrostatic adhesion, an open, stable, loop. The resulting open loop leaves the treated hair open to air so that oxidation of the treating agents can take place during the process, and also allows the colorist to view the progress of the hair treating process without the need to open the looped sheet.

25 Claims, 4 Drawing Sheets

DEVICE AND PROCESS FOR USE IN COLORING HAIR

BACKGROUND OF THE INVENTION (a) Field of the Invention

This invention relates to a hair treatment device for use in applying dyeing, and bleaching chemicals to hair to achieve highlighting, frosting, and multi-color weaving. More specifically, it relates to a hair device in the form of a flexible wrap which includes means to isolate a portion of the hair for chemical treatment, and to methods of using such a device.

(b) Description of the Prior Art

Currently dimensional hair coloring, including highlighting, frosting, and multi-color weaving has come to the forefront of the hair colorist art. Although many products and methods have been used in the art of color application, few, if any, satisfy all of the needs of the modern professional colorist.

Included in these prior art techniques is hair painting, which is an elementary method of achieving dimensional or contrasting hair color. In this method the colorist applies a liquid bleach or coloring agent directly to the portion of the hair which is to be colored. However, the liquid penetrates the entire depth of the hair, which is not desirable where the intent is to achieve precision dimensional results. While it may seem simple, it is in fact a difficult and inefficient way to achieve the desired results.

In another method it has been suggested to use a pastry bag and a thickened coloring agent. This method provides the benefit of providing greater control of the application of the coloring agent than is possible using a brush and thin liquid as in the painting method. This method also has the advantage of even color flow and a reduced need for the colorist to repeatedly dip a brush into the coloring agent. However, there is still the possibility of color bleeding onto hair that is not intended to receive color. While this method is superior to hair painting, it produces far from totally satisfactory results.

The use of specially designed cups for coloring hair has been suggested to aid in isolating only the hair to be treated or receive color. Such cups consist of a base member having a slit for receiving hair. In use, a portion of the hair which is to be woven is inserted in the slit of the cup base, and the base is then positioned as close to the scalp as possible by tensioning with one hand and pushing the base against the head with the other hand. The hair protruding from the cup is then wound and compacted into the cup which is then press fitted onto the base. This procedure is repeated until all portions of the hair to be colored are enclosed in the cups. The coloring agent is then introduced to the cups and allowed to process to completion. While this technique is an improvement over the prior methods described, in that it isolates the hair to be colored, it is still subject to many disadvantages. For example, in the use of such cups, it has been found necessary to first wet the hair before applying the cup base in order to provide enough friction in the slit to hold the base in place. However, as the hair dries the cups tend to slide away from the head due to a reduction in friction, and the colorist must continually reposition the cups. Most detrimental to the use of such cups is the fact that the compacting of hair into the cups severely limits the ability of ambient oxygen to access the coloring or dyeing chemicals, thereby retarding the oxidation process necessary for full color development of most coloring agents. Furthermore, no matter how carefully the cup bases are applied or, how much the colorist adjusts them to maintain them in place, the cup bases still occupy at least about one quarter inch of space on the hair adjacent to the scalp, which occupied space will not be treated by the coloring agent, thereby leaving the roots of the hair or a portion of hair and scalp discolored. Furthermore, the water which is applied to provide friction to the hair dilutes the coloring agent. Additionally, since the cups are about one inch in diameter the sections of hair to be colored must be at least one inch apart, thereby limiting the effects which can be achieved, and making retouching of new hair growth difficult. As this method requires a colorist to apply and then manipulate a plurality of cups, it is very time consuming and very inefficient.

A cap frosting method is sometimes used to achieve dimensional hair coloring. In this method a close fitting rubber or plastic cap is pulled tightly over the to-be-colored head. The cap is provided with a plurality of small holes through which the colorist can inserts a small crochet hook to pull a bundle of strands of hair through the hole in the cap. This procedure is repeated as often as necessary to achieve the desired effect, e.g., 50 to 100 times. The hair thus isolated through the holes from the hair under the cap is then treated with a coloring agent and allowed to process. After the processing is completed the cap is removed from the head and the hair is shampooed to remove the excess or unreacted coloring agent. While among the easiest of the prior art methods, cap frosting still has many disadvantages. There is a substantial amount of hair underneath the cap which holds the cap away from the head. Therefore, when the colorist inserts the crochet hook to retrieve hair from underneath the cap, hair may be pulled from a scalp portion not located directly under the hole, thus, roots and sections of hair which are close to the scalp may not receive coloring agent, thereby creating an undesirable effect. Also, the cap method makes it difficult to apply more than one type or color of coloring agent to the hair for fear of adjacent portions of differently colored hair blending the coloring agents. This method by nature is haphazard at best and ineffective for the demands of the modern colorist.

A very difficult and time consuming technique of the prior art, is the basic foil method. In the basic foil method, the hair to be colored is first isolated by known weaving techniques, and then a sheet of aluminum foil is placed against the scalp with the edge of the foil as close to the roots of the to-be-treated hair as possible. The coloring agent is then applied to the isolated strands of hair within the foil sheet. The lower end of the foil is then folded towards the head two or more times, and the sides are folded inward toward the center to form a rigid, sealed, crimped packet containing hair which has been treated with coloring agent. This procedure is repeated approximately fifty times for a full head of hair. While the basic foil method is excellent for isolating desired strands of hair, it does have many serious drawbacks. The most important drawback is that it creates a substantially air tight envelope. Most known permanent coloring agents include some amount of hydrogen peroxide, and require ambient oxygen from the air in order for a chemical reaction, known as oxidation, to take place and to work as designed and suggested by their manufacturers. By the substantially air tight folding and crimping of the foil, the colorist and client are denied the proper use of such coloring agents, with the result that there is uneven color distribution, with some portions of the hair being under processed, while other portions of the hair may be over processed, and perhaps damaged. When using foil, additional damage is sometimes done to the hair by placing the client under heat to force the color development process due to the lack of oxidation.

This basic foil technique also requires the tedious and time consuming effort in simultaneously holding the hair and the foil while also weaving the hair. Most often, a third hand is needed to accomplish this, in most cases in the form of a costly assistant to hold the foil in position. Once in place, the foil has a tendency to slip away from the scalp area due to manipulation in applying the coloring agent, the folding and crimping process, and its own weight. Such slipping causes the coloring agent to be removed from the root area, and also allows exposed coloring agent to blend onto adjacent strands of hair which are not intended for coloration. After the coloring agent and foil are applied to the hair, then during processing the foils must be reopened to inspect the color development, thereby increasing the risk of color bleeding onto the scalp and surrounding hair resulting in blotchy or patchy uneven color as a result of such slippage. The basic foil technique also requires that the foil strips be precut to adjust to different lengths of hair while hair in excess of a certain length, say over ten inches, is compacted into the foil envelope which is formed, thereby further increasing the uneven distribution and processing of the coloring agent on the treated hair, with an inferior end result appearance.

Variations of the basic foil method have been suggested, such as in Minghenelli U.S. Pat. No. 4,196,741, which discloses the use of liquid-impermeable sheets of aluminum foil, which are provided with a coating of pressure-sensitive adhesive, such as a double sided adhesive tape, which is adjacent to one edge of the sheet, with an optional stripable cover over the pressure-sensitive adhesive in order to protect it prior to use. The process of using such a foil comprises separating a portion of to-be-treated hair from the remaining hair on the head, adhering one of the liquid-impermeable foil sheet to the scalp and hair of the head immediately adjacent to and below the roots of the portion of hair to be treated, and treating the selected portion of hair with any desired liquid coloring agent, such as a bleach or dye, and permitting the treated hair to overlie the central portion of the liquid-impermeable adhesively adhered foil sheet while the coloring agent is processed. Optionally, the foil sheet taught by Minghenelli may be folded or rolled toward the head, followed by folding the edges inwardly to form an envelope, thus isolating the coloring agent from the remainder of the head of hair and treating only the selected portion of hair, as in the basic foil method.

In another variation of the foil technique, a foil with a transparent plastic window, and also with an adhesive strip having a pull away protective adhesive covering is known in the prior art. Not only do these devices and the methods of using them insert extra steps into the application, but the adhesives have a tendency to adhere to the porous hair shaft more strongly than to the non-porous foil, and therefore tend to release the adhesives onto the porous hair shaft. These additional steps do nothing to improve on the quality and/or ability of the basic foil method to allow oxidization, to increase the speed of application, or to allow for the proper use of the color agent.

Most recently, a European device which is used in hair coloring business, and which is designated as L'Oreal EASI MECHE has been found. It carries what appears to be a European patent application number 0/122/145, but efforts to find that application have been unsuccessful as of the date of filing this application. Upon examination of this device and its instructions, the L'Oreal EAST MECHE device is found to be comprised of three different pieces: an opaque backing strip, an adhesive strip across the top edge of the opaque backing strip, and a clear front cover. The opaque backing strip is composed of thin, opaque non-porous plastic material, and serves as a backing strip which will lay next to the head of a person having their hair colored. The clear front cover is a thin transparent sheet of non-porous plastic material which lays over the top of the opaque backing sheet. The opaque backing strip and the clear front cover are joined together, by heat welding, at their common bottom edges to form a permanent crease which is capable of being opened, like a file folder, to receive to-be-treated hair. The bottom crease is separated from and opposed to the position of the adhesive strip. When the device is used, a portion of to-be-treated hair is selected or woven from the roots out, the backing strip and the clear front cover are separated, the backing strip is placed under the to-be-treated hair, with the adhesive strip facing up and away from the scalp, and to-be-treated hair is placed on and secured to the adhesive strip. The to-be-treated hair is then treated with coloring agent, and the front cover portion is then closed and secured to the adhesive strip, thereby forming, with the opaque backing strip, a non-porous sandwich around the hair. It is noted that this device is quite heavy, and that the adhesive is facing away from the head, so that the hair that is to receive coloring agent is attached to the adhesive strip, thereby exposing the adhesive strip to coloring agents. While the adhesive is very aggressive when dry, when it is moistened with color agent, it may slide down the hair due to the weight of the strip. Also, because of its closed sandwich structure, the stylist must pre-open all of the sheets which will be used, or have an assistant or the client open the sheets. Since the device is made of non-porous plastic material and is completely closed at the crease, in use it inhibits the flow of the oxygen in the air to the coloring agent, thereby inhibiting oxidation, much like the foil devices. When processing is completed using the EASI MECHE device, each sandwich must be separately opened at its own adhesive closure, and the hair carefully removed from each adhesive strip, another time consuming process.

Other hair coloring variations have been suggested, such as the use of Saran type plastic wrap in a manor similar to foil, untreated paper, clamps, plastic boards, powdered coloring agents, and the like. While the prior art has suggested many methods of achieving dimensional or contrasting hair coloring, no simple or highly effective device for this purpose has been established.

None of these prior art devices or patents specifically describe a device designed to achieve dimensional or contrasting hair coloring, including highlighting, frosting, and multi-color applications which avoid all of the prior art problems, while satisfying all of the needs of the modern professional colorist. No such method or device provides an efficient way to achieve the desired satisfactory results which exclude the possibility of color bleeding onto hair that is not intended to receive color, or avoids the need to first wet the hair and thereby dilute the coloring agent, or which device will not tend to slide away from the head, require continual repositioning, readily allow ambient oxygen to access the coloring or dyeing chemicals to thereby allow the oxidation process necessary for full color development of the coloring agents, or not occupy a portion of the hair adjacent to the scalp which will not be treated by the coloring agent, or not be space consuming, and make retouching of new hair growth difficult, or which is not inefficient and time consuming, or which allow roots and sections of hair which are close to the scalp to not receive coloring agent, which allow the simultaneous application of more than one type of coloring agent to the hair, and which does not damage the hair, or require an assistant. Where a pressure sensitive adhesive is used with a foil or a plastic strip, the prior art devices fail to secure the adhesive to the foil more securely than to the hair of the client, and tends to either release onto the porous hair shaft, or slide down the hair.

SUMMARY OF THE INVENTION

It is therefore an object of the present invention is to provide a realistic tool for use in the application of dimensional and contrast hair coloring which is capable of treating an entire hair shaft without difficulty, and using only ordinary colorist skill.

It is another object of the present invention to provide such a tool for use in the application of dimensional and contrast hair coloring which makes the proper use of most known permanent hair coloring agents possible in it's most elementary and economical form.

It is another object of the present invention to provide such a tool which provides its own adhesion to the hair of a person undergoing color application treatment in a manner such that it does not add extra steps or require complicated steps, and even eliminates the need for an assistant.

Another object of this invention is to provide such a tool which provides speed and accuracy to hair color application treatment in a manner that saves time and increases the colorist's productivity.

It is another object of this invention to provide such a tool in the form of a two sided strip of porous material which is bonded to or coated on its first side with a liquid resistant coating or layer, while leaving its second side porous, and further including an adhesive strip on second porous side of the strip, thereby allowing maximum adhesion of the strip to the hair of a person undergoing color application treatment, while allowing the maximum oxidation necessary for full color development, as intended for the coloring agents, by allowing air to travel the full length of the hair shaft.

It is another object of the present invention to provide such a tool which can be used for coloring hair of any length by adhering the adhesive portion of one strip at the bottom coated surface of another strip until the desired treatment length is achieved.

It is another object of the present invention to provide such a tool which allows a colorist the ability to monitor color development without removing, reopening or making unnecessary adjustments to the tool, thereby allowing thorough and even color development along the entire length of the hair shaft, while avoiding activity which causes slippage and other undesirable effects.

It is another object of the present invention to provide such a tool which allows a method of use which substantially reduces the time required for its application as compared to all other known dimensional hair coloring application methods.

These and other objects of the present invention are achieved by providing new articles or devices, substantially in the form of a sheet, for use in hair coloring, and especially for use in precision dimensional coloring, highlighting, and streaking of hair. In their simplest form the new device is comprised of several elements which are combined to form a sheet. The first element is a porous strip having a first and a second side which have first and second surfaces, respectively, a first and second end, and a length and a width dimension. The second side of the porous strip has a thin layer of liquid-impermeable material adhered to and substantially covering the entire second surface. A pressure sensitive adhesive element is adhered along or substantially adjacent to the first end of the first side of the porous strip. As detailed below, the pressure sensitive adhesive elements is used to attach the sheet firmly, but releaseably, to the scalp and hair of a person's head immediately adjacent the roots of a portion of hair which is to be dimensionally bleached or colored.

As used herein, the term "porous strip" includes micro-porous, semi-porous and porous materials which are air permeable or breathable. Such porous material may be composed, for example, of light weight paper, fabric, and even certain forms of plastic. Porous bond paper is preferred, ranging from about 4 pound stock to about 20 pound stock, although both lighter and heavier paper stock and non-bond paper stock may be used as the porous strip in the practice of the present invention. In addition, fiber or fabric based materials, both natural, such as cotton, and synthetic, such as rayon, and most other types of porous fabrics and fabric blends may be used to provide the porous strip for use in the article of the present invention. Micro-porous air permeable materials, such as spun bond polypropylene plastic, may also be used for this purpose.

The liquid-impermeable material adhered to and substantially covering the entire second surface of the porous strip is preferably plastic. It may be present as a thin coating on the surface of the second side of the porous strip, or as a layer which is bonded to substantially the entire surface of the second side the porous strip, or as a layer which is otherwise mechanically applied to the second side the porous strip. Any commercially available coating or film of liquid-impermeable material may be used to substantially cover the second surface of the porous material. For example, the liquid-impermeable-material may be any commercial plastic material which can be coated, mechanically connected, or otherwise applied in a thin layer and bonded to substantially the entire surface of the second side of the porous material to provide a water and chemical resistant surface that is inert when contacted by coloring agents. It is also important, as explained below, that the combined porous strip and liquid-impermeable layer sheet be sufficiently light weight so that they do not cause the adhesive elements to slip, when pressed against the hair, and that they have sufficient body or stiffness so that when it is wetted and formed into a loop, that the loop maintain its form, and not collapse.

Any suitable commercially available, pressure-sensitive adhesive elements may be used in the present invention, the principal requirements being that the adhesive be firmly but releaseably adherent to the hair, and that the adhesive have greater adherence to the porous strip material than it does to the hair. This is necessary so that the adhesive will adhere to the porous strip material more strongly than to the hair when the sheet is removed from the head after use. The adhesive may be coated directly on to the liquid-impermeable surface along or adjacent to the first end of the sheet. It may also be a tape, including a two sided tape with one side of the tape securely fastened to the liquid-impermeable surface, and the other side of the tape providing an exposed adhesive for adhering the sheet to the hair.

In practice, a strip of adhesive, or of double coated adhesive tape is applied to the first surface of the porous strip material adjacent to or slightly inwardly of the first end of the first surface which is to be adhered to the hair adjacent to the roots of the portion of hair which is to be treated. While the adhesive may be located at any portion of the first edge, it is preferred that the adhesive extend substantially across the entire width of the first end of the sheet. The other ends of the sheet are preferably left free of adhesive, although hydrostatic attraction is used to connect the second end to the first end, as detailed below.

The adhesive elements allows a colorist to place the first end of the sheet with the adhesive elements on the hair adjacent to the scalp, but not directly on the scalp. After the adhesive elements is at the desired location, the colorist then presses firmly on the liquid-impermeable surface to adhere the adhesive element firmly in place against the underlying hair, and with the porous surface of the liquid-impermeable coated sheet.

Then, the colorist using art known weaving techniques, weaves the desired amount of hair strands out and over the face of the liquid-impermeable surface, followed by the treatment of the hair on the liquid-impermeable surface with a wet coloring agent. The entire length of the hair, or only portions thereof may be so treated, depending on the effect which is desired. The sheet maintains its body because the coloring agent does not penetrate the liquid-impermeable surface on which the hair rests. After the hair on the liquid-impermeable surface is treated with a wet coloring agent, the colorist then bends or curves the outside bottom, or second end of the second side of the liquid-impermeable surface, to the top, or first end of the sheet, and then simply presses the two ends together so that the sheet forms an open, stable, loop, by hydrostatic adhesion. When the loop is so formed, the hair remains firmly adhered to the surface of the liquid-impermeable second surface due to the moisture of the wet coloring agent. The resulting open loop also allows the second side of the sheet, including the treated hair, to be open to the ambient air so that full oxidation of the coloring agents can take place during the process. At the same time, the liquid-impermeable second surface does not allow any moisture or coloring agents to bleed through the sheet when the second end or bottom is bent or curved towards, and into contact with the first end, or top, to form and maintain the open loop as the sheet maintains its body during subsequent processing.

It is here noted that the hydrostatic adhesion which is used to connect the second end of the sheet to the first end enhances the non-slipping attributes of the present invention, and completely eliminates the prior art problems of unintentionally leaving root areas uncolored, or of accidently coloring areas of the hair that are not to receive color agent due to slippage. By exposing the hair and coloring agent to the air in the open loop, it allows the full and complete oxidation of the coloring agents, as noted above, and thereby eliminates the prior art problems caused by the lack of or uneven nature of coloring agent oxidation. In addition, the size of the open loop allows the colorist to have open access to the progress of the coloring process, without the need to open the looped sheet. No up front preparation of the sheet is required and no time consuming folding, bending or crimping is needed or required after the sheet is adhered to the hair, and the coloring agent is applied, thereby allowing the desired results to be achieved without many of the time consuming steps required in the use of prior art devices. The self adhesive highlighting strip of the present invention has the added advantage and feature of allowing a single strip application and removal technique for two or more colors or other treatments simultaneously.

The fact that the pressure sensitive adhesive coated on the porous material gives it a much greater degree of adhesion to the porous material than it does to the underlying scalp or thus allowing it to be released easily when pulled by the colorist. Thus, to remove the sheet when the coloring process is completed, all that is required is for the colorist to simply pull it off. Where the sheets are placed on the head adjacent to and in contact with one another, all of the sheets come off together in one single strip when you remove one and pull it away from the head. It is thus seen that the device of the present invention allow for both extremely quick application and removal.

In one preferred embodiment, the sheet devices of the present invention may be packaged with the pressure sensitive adhesive of a first sheet adhered to a backer sheet, and then with the pressure sensitive adhesive of a second sheet adhered to the liquid-impermeable surface of the first sheet, and so on, to provide a stack of readily accessible, easily removed sheets. In this manner, a stack of a large number of sheets, say, about 250 sheets, thus providing a supply which allows a colorist, without any assistance to easily lift one sheet at a time away from the stack. In the alternative, an easily removable release strip may be placed over the adhesive portion of each sheet.

The herein described sheets of the present invention may be produced in widths from about as little as one inch to as much as six inches or more, and may be produced in lengths of from about four inches, or less, up to twenty four inches, or more, and of course to varying intermediate lengths, depending on the length of the to-be-treated hair. Also, as will be detailed below, when coloring longer hair, a plurality of sheets can be joined together by taking a first sheet, and adhering the adhesive element of a second sheet to the liquid-impermeable surface of the first sheet, and so on, until a strip of any desired length is constructed.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
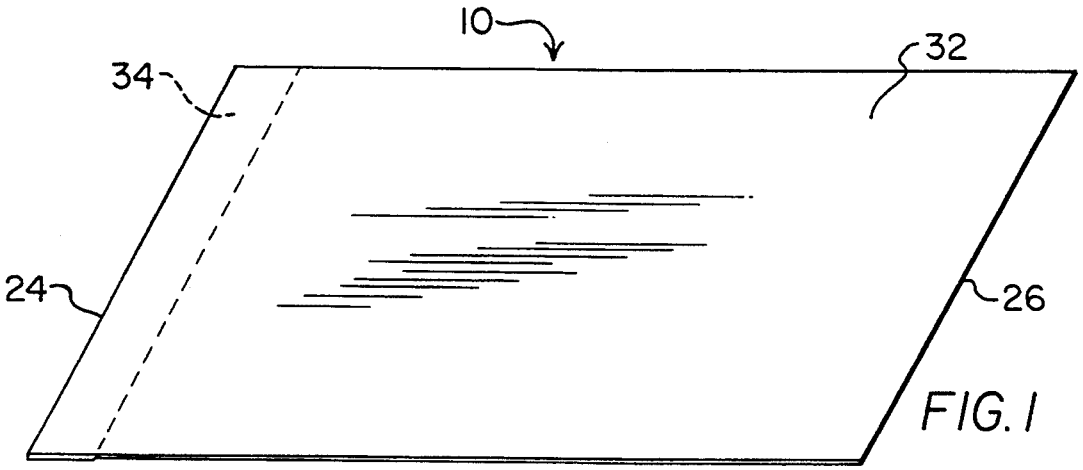
FIG. 1 is a top perspective view of the hair treating device of the present invention.

Now, referring to the drawings, in which like numbers represent the same elements in the various figures. FIG. 1 shows the hair treating device, or flexible sheet, generally 10, of the present invention. FIGS. 2–5 show the details of flexible sheet 10, in which a porous strip 12, having a first side 14, a second side 16, a first surface 18 coincident with side 14, a second surface 22 coincident with side 16, a first end 24 and second end 26, and a length and a width dimension. The second side 16 of porous strip 12 has a thin layer of liquid-impermeable material 32 adhered to and substantially covering the entire second surface 22. A pressure sensitive adhesive element 34 is adhered along or substantially adjacent to the first end 24 of the first side 14 of porous strip 12. As detailed below, the pressure sensitive adhesive element 34 is used to attach the sheet firmly, but releaseably, to the hair 42 (FIGS. 6–11) of the head 44 of a client or user 46, immediately adjacent the roots of a portion of hair 42 which is to be dimensionally bleached or colored. As shown, pressure sensitive adhesive element 34, may be a coating or strip or adhesive, or of double sided adhesive tape.

In actual use, porous strip 12, liquid-impermeable material 32, and adhesive element 34 are so thin that their separate nature is not normally discernable to the unaided eye, and they appear to be a single, unitary flexible sheet.

Figure 4:
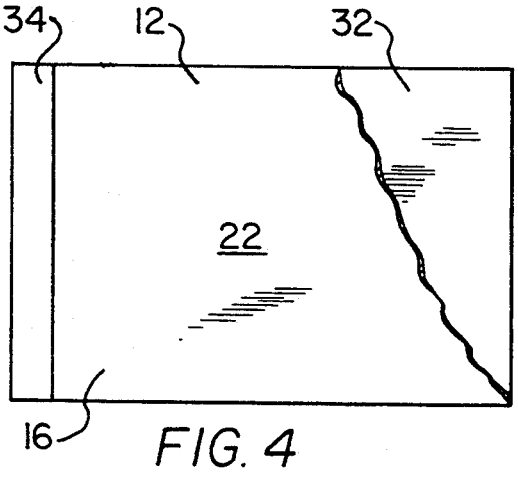
FIG. 4 is a bottom plan view of the hair treating device of FIG. 1, partially broken away to show the liquid-impermeable layer beneath the breathable layer.
Figure 5:
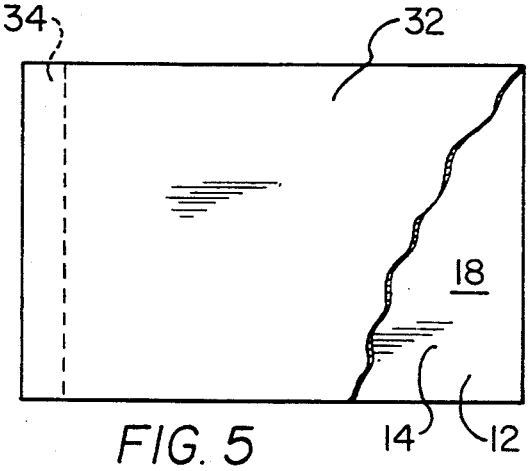
FIG. 5 is a top plan view of the hair treating device of FIG. 1, partially broken away to show the breathable layer beneath the liquid-impermeable layer.
Figure 6:
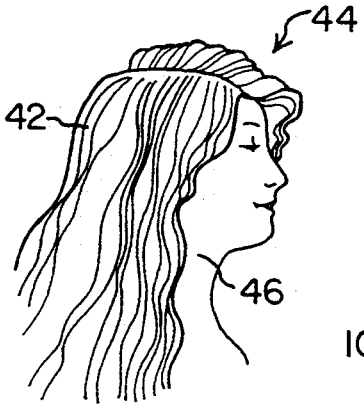
FIG. 6 is an illustration of a side view of the hair of a user in which a part line has been formed before the device of the present invention has been applied.

FIG. 4 shows is a bottom plan view of hair treating device 10, partially broken away to show the liquid-impermeable layer 32 beneath porous strip 12, while FIG. 5 is a top plan view of hair treating device 10, partially broken away to show porous strip 12, beneath liquid-impermeable layer 32.

Figure 7:
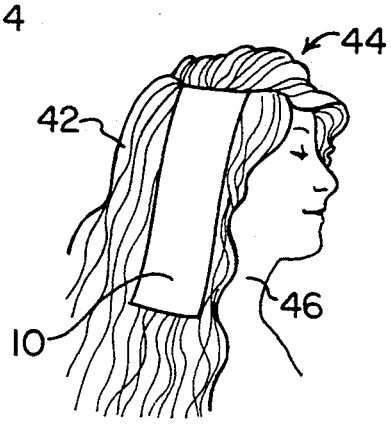
FIG. 7 illustrates the hair of the user of FIG. 6 after one hair treating devices of the present invention has been applied along the part line.
Figure 8:
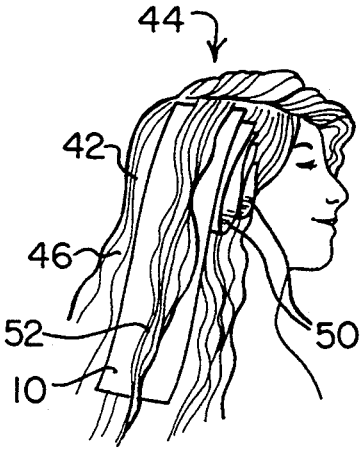
FIG. 8 illustrates the hair of the user of FIG. 6 after several hair treating devices of the present invention have been applied along the part line and formed into open loops, and showing several strands of hair which have been woven onto the liquid-impermeable layer.
Figure 9:
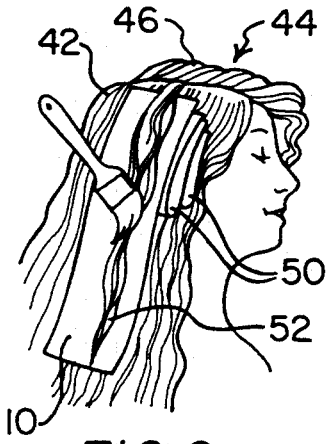
FIG. 9 illustrates the strands of hair which have been woven onto the liquid-impermeable layer in FIG. 8 being treated with moist hair treating chemicals using the hair treating devices of the present invention.
Figure 10:
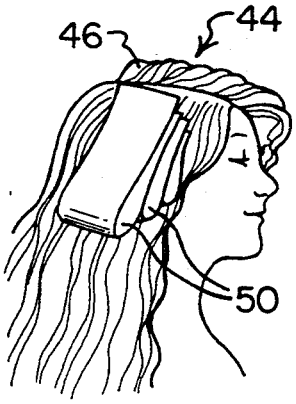
FIG. 10 illustrates the hair treating devices of the present invention formed into an open loop, and held in loop form by hydrostatic attraction, after the step of FIG. 9.
Figure 11:
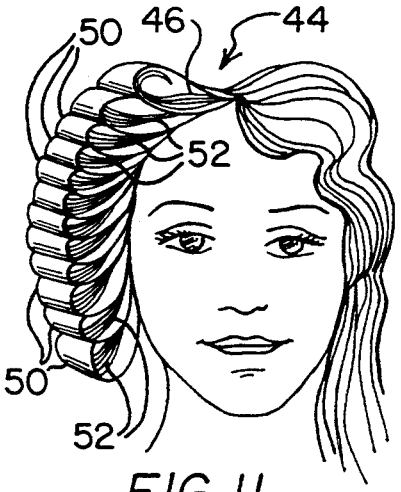
FIG. 11 is an enlarged front view of FIG. 10, more clearly illustrating a plurality of the hair treating devices of the present invention formed into open loops, and held in loop form by hydrostatic attraction.

Now, referring to FIGS. 6–11, a side view of the hair 42 of the head 44 of a client or user 46, in which a part line 48 is formed before the device 10 of the present invention has been applied. In FIG. 7, the hair 42 of user 46 is shown after one hair treating device 10 of the present invention has been applied along the part line 48. In FIG. 8, the hair 42 of the user has had several hair treating devices 10 applied along part line 48, and formed into open loops 50, and shows several strands of hair 52 which have been woven up onto the surface of liquid-impermeable layer 32. In FIG. 9, the strands of hair 52 which have been woven onto the liquid-impermeable layer in FIG. 8 are being treated with moist hair treating chemicals. FIG. 10 illustrates the hair treating devices 10 of the present invention formed into an open loop 50, and held in that loop form by hydrostatic attraction, after the step of FIG. 9. FIG. 11 is an enlarged front view of FIG. 10, which more clearly illustrates a plurality of the hair treating devices 10 of the present invention formed into open loops 50, and held in loop form by hydrostatic attraction.

Referring again to FIG. 8, a number of devices 10 in loop form 50 are shown to be in place. Then, a fresh sheet 10 with adhesive element 34, not visible in FIGS. 7–11, is pressed firmly against hair 52, and in overlapping contact with another sheet 10. As shown, after adhesive element 34 has been placed at the desired location, the user 46 or colorist treats the strands of hair 52 on the liquid-impermeable surface 32 with a wet coloring agent. The sheet 10 maintains its body because the coloring agent does not penetrate the liquid-impermeable surface 32 on which the strands of hair 52 rest. After the hair 52 on the liquid-impermeable surface 32 is treated with a wet coloring agent, the colorist then bends or curves the outside bottom, or second end 26 of the liquid-impermeable surface 32, to the top, or first end 24 of the sheet, and then simply presses the two ends together so that the sheet 10 forms an open, stable, loop, by hydrostatic adhesion. When the loop 50 is so formed, the hair 52 remains firmly adhered to the surface of the liquid-impermeable second surface 32 due to the moisture of the wet coloring agent. The resulting open loop 50 also allows the second side of sheet 10, including the treated hair 52, to be open to the ambient air so that full oxidation of the hair treating agents can take place during the process. At the same time, the liquid-impermeable second surface does not allow any moisture or coloring agents to bleed through the porous material 12, when the second end 26 is bent or curved towards, and into contact with the first end 24 to form and maintain the open loop 50 as the sheet maintains its body during subsequent processing.

Figure 12:
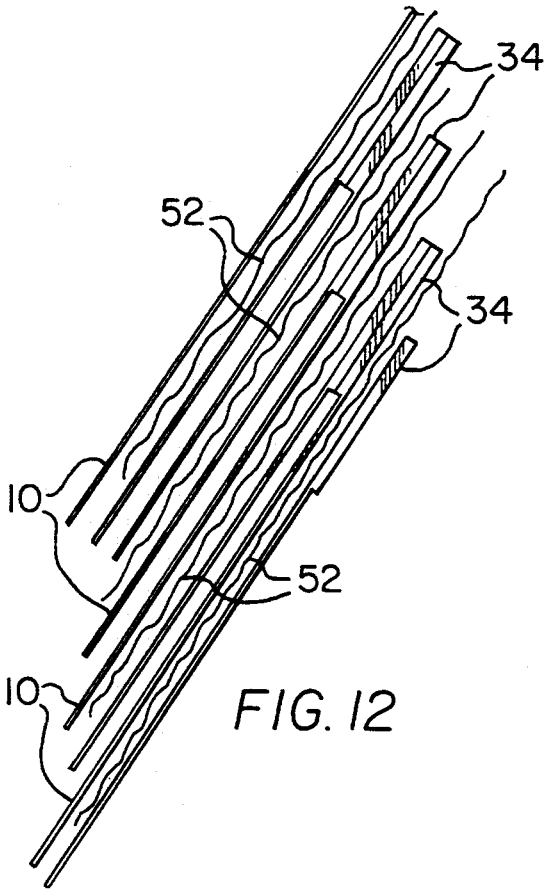
FIG. 12 is an enlarged and exaggerated side view of a plurality of the hair treating devices of the present invention with their adhesive portions overlapping one another.
Figure 13:
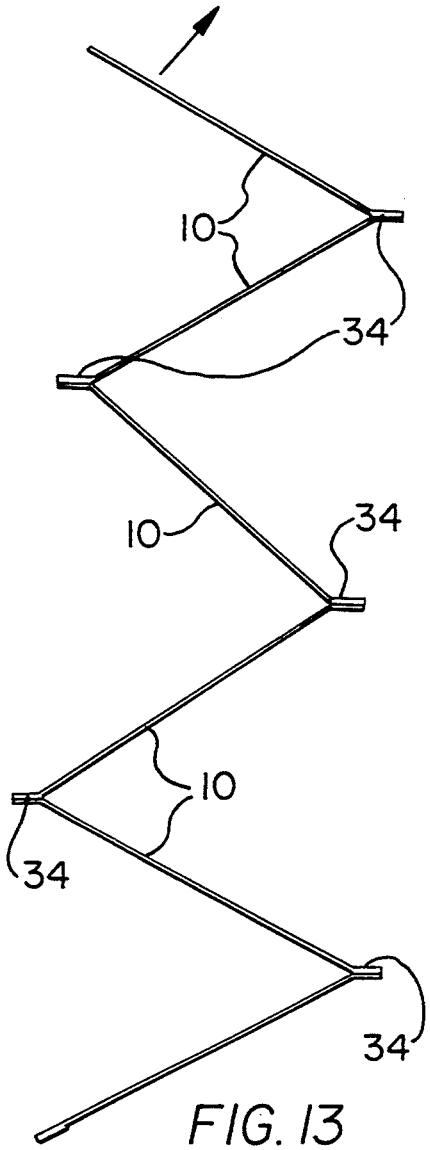
FIG. 13 is an exaggerated illustration of a plurality of the hair treating devices of FIG. 12, with their adhesive portions overlapping one another, after one end of one device of the present invention has been pulled, and removes with it a plurality of the hair treating devices of the present invention with their adhesive portions overlapping one another, when one is pulled.

FIG. 12 shows an enlarged and exaggerated side view of a plurality of the hair treating devices 10 with their adhesive portions 34 overlapping one another. This allows, as shown in FIG. 13 in an exaggerated illustration, a plurality of hair treating devices 10 with their adhesive portions 34 overlapping one another, after one end of one device 10 has been pulled, and removes with it a plurality of overlapping hair treating devices 10, with their adhesive portions 34 overlapping one another, when one is pulled.

Figure 14:
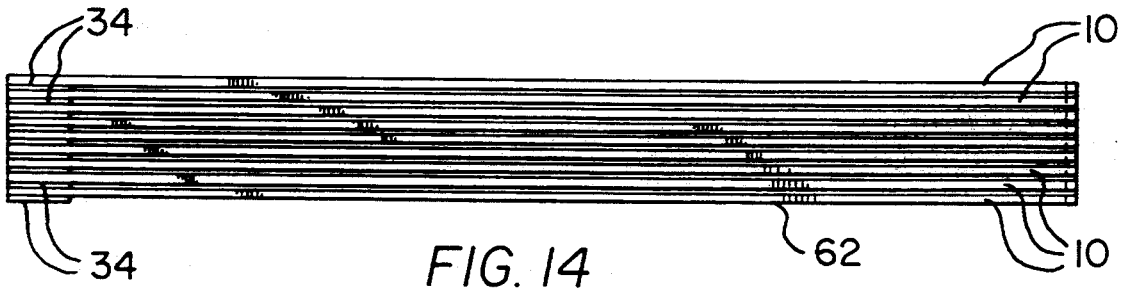
FIG. 14 is an exaggerated side view illustration of a pluralit of the hair treating devices of the present invention showing the adhesive portion of the lower most device securing it to a backing strip, and with each other device using its adhesive portion to secure it to each preceding device, to form a stack.

As a preferred method of packaging devices 10, FIG. 14 is an exaggerated side view illustration of a plurality of the hair treating devices 10, showing the adhesive portion 34 of the lower most device 10 secured to a backing strip 62, and with other devices 10 using their adhesive portions 34 to secure them to each preceding device 10, to form a stack.

Figure 15:
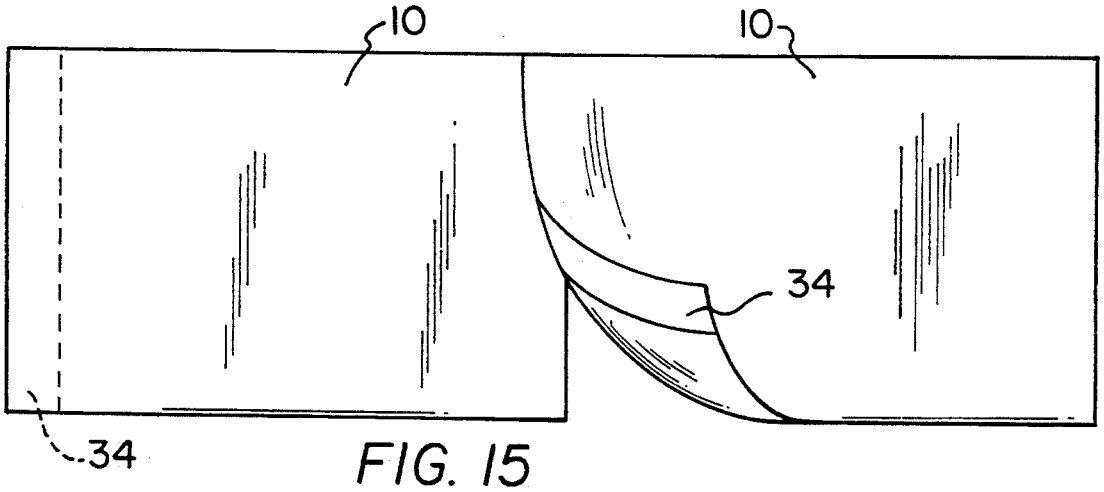
FIG. 15 is a top plan view showing one of the hair treating devices of the present invention being attached to another hair treating devices of the present invention, to thereby provide an elongated hair treating device.

FIG. 15 is a top plan view showing one of the hair treating device 10 of the present invention being attached to another hair treating device 10 of the present invention, to thereby provide an elongated hair treating device.

Figure 2:
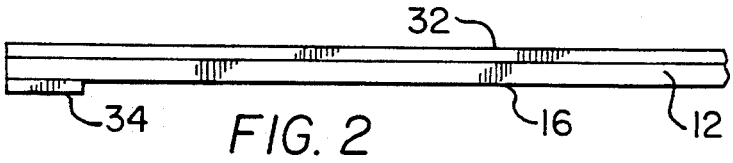
FIG. 2 is an enlarged and exaggerated, broken away side elevational view of the hair treating device of FIG. 1.
Figure 3:
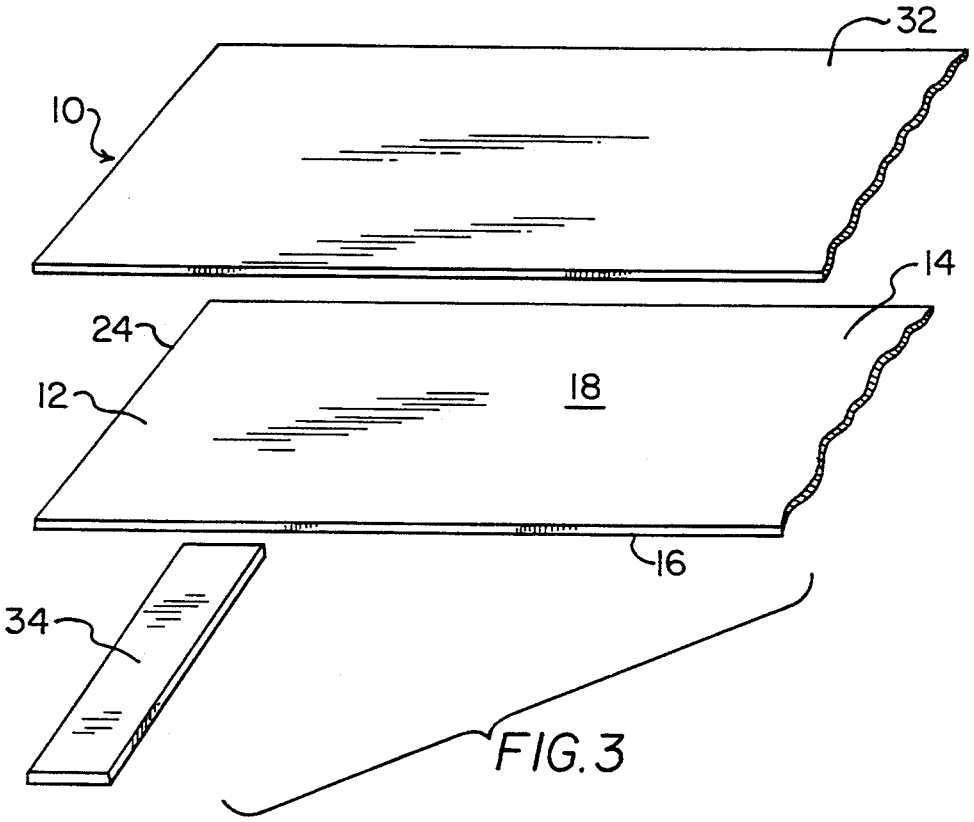
FIG. 3 is a top perspective exploded view of the enlarged and exaggerated, broken away view of FIG. 2.
Figure 16:
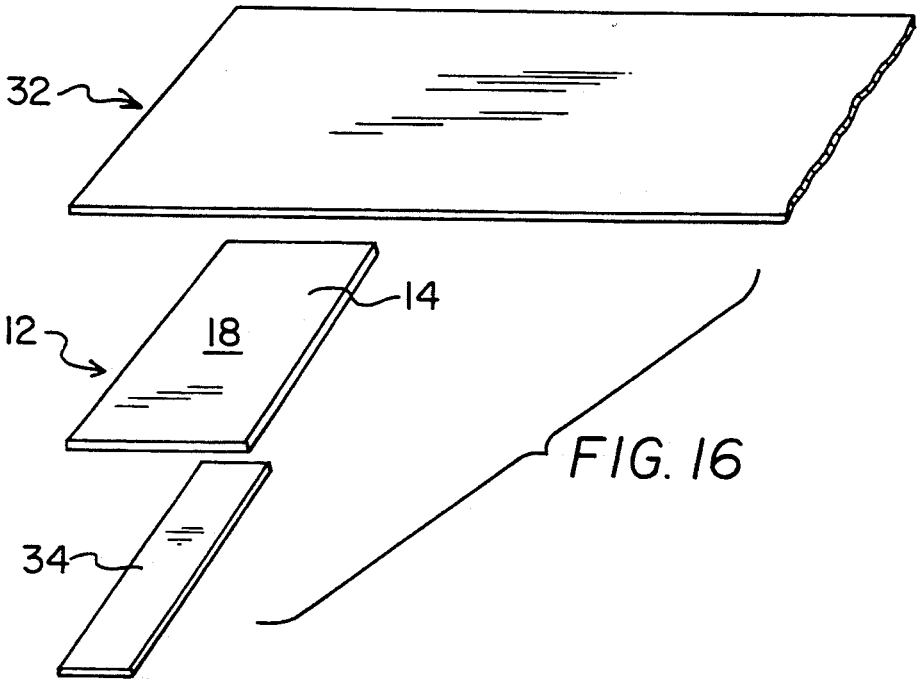
FIG. 16 is a top, enlarged and exaggerated, broken away perspective exploded view, similar FIG. 2, of a modified form of the present invention.

FIG. 16 is a top, enlarged and exaggerated, broken away perspective exploded view, similar FIG. 2, of a modified form of the present invention, in which porous strip 12 does not coincide with the entire liquid-impermeable strip 32, but in which adhesive element 34 is aligned to be secured to porous strip 12.

Figure 17:
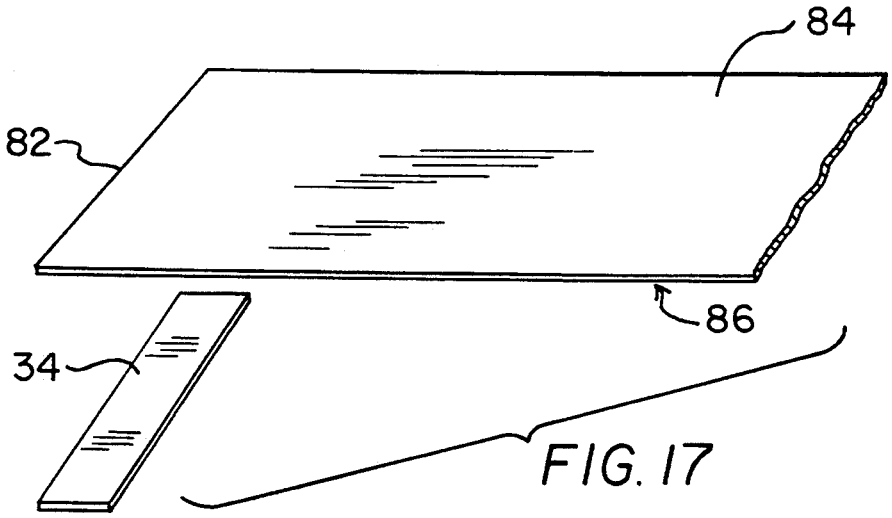
FIG. 17 is a top, enlarged and exaggerated, broken away perspective exploded view, similar FIG. 2, of a modified form of the present invention.

FIG. 17 is a top, enlarged and exaggerated, broken away perspective exploded view, similar FIG. 2, of a modified form of the present invention, in which the thin, flexible strip of liquid-impermeable material and the porous material are a single combined unit 82 having a first liquid-impermeable side 84 and a second porous side 86, the pressure sensitive adhesive 34 element being adhered to the porous side of the combined unit 82. In preferred embodiments, unitary flexible sheet 82 is micro-porous air permeable material, such as spun bond polypropylene.

It is therefore seen that the hydrostatic adhesion which is used to connect the second end 26 of the sheet 10 to the first end 24 enhances the non-slipping attributes of the present invention, and completely eliminates the prior art problems of unintentionally leaving root areas uncolored, or of accidently coloring areas of the hair that are not to receive color agent due to slippage. By exposing the hair 52 and coloring agent to the air in the open loop, it allows the full and complete oxidation of the coloring agents, while the size of the open loop allows the colorist to have open access to the progress of the coloring process, without the need to open the looped sheet.

It will be appreciated that in the use of devices 10 of the present invention that no preparation to use sheets 10 is required and no time consuming folding, bending or crimping is needed or required after the sheet 10 are adhered to the hair 42, and the coloring agent is applied, thereby allowing the desired results to be achieved without many of the time consuming steps required in the use of prior art devices.

This invention offers the only known device to with which a hair part can be made, followed by the colorist positioning the sheet or highlighting strip 10 adjacent to the scalp then, at the very top of the strip weave the desired amount of hair strands 52 out and over the liquid-impermeable surface of the highlighting strip, after which the coloring agent is applied as desired and the strip 10 is then bent, as described. When this is followed by another strip 10 being positioned just above the preceding strip with the bottom one half portion of the adhesive side being attached to the top of the preceding strip 10 and the other top half of the adhesive 34 being attached to the hair 42. The colorist will repeat the weaving and color agent application as desired, and may be repeated as many as about 50 to about 75 times, or as desired for a required effect.

It will be appreciated that this procedure creates one continuous strip through out the hair and allows the colorist to remove the strips in one continuous motion by removing one highlighting strip with the other strips following one another due to the fact that they have been attached together by the adhesive on each strip in the initial application process. It should now be apparent, the colorist may very quickly remove all of the strips 10 in one continuous motion, so for example, should the coloring agent start to over process, it can be quickly removed and stopped, thus avoiding hair damage.

It is therefore seen that the device of the present invention eliminates the unnecessary features and the inherent problems of the modern hair colorist which are associated with and presently found within this type of color application using foil and paper application products.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A device for use in hair treatment in the form of a flexible sheet, including in combination:

a thin, flexible strip of liquid-impermeable polymeric material having a first and a second side which have first and second surfaces, respectively, a first end and a second end, and a length dimension and a width dimension, said liquid-impermeable polymeric material exhibiting hydrostatic adhesion when said width of said first surface of said first or second end is wetted and said first and second ends are pressed together to form a loop, said liquid-impermeable polymeric material having sufficient body and stiffness to maintain any such loop which is formed in an open form through which air can pass, said second end of said flexible strip being free of material which will interfere with the hydrostatic adhesion of said first surface of said second end with said first end;

a thin, flat strip of porous material having a first and a second side which have first and second surfaces, respectively, said first surface of said thin, flat strip of porous material being secured to said second surface of said thin, flexible strip of liquid-impermeable polymeric material at least along or substantially adjacent to said first end of said flexible strip; and a pressure sensitive adhesive element adhered to said second surface of said porous thin, flat strip, at least at the portion which is below and along or substantially adjacent to said first end of said flexible polymeric strip, said pressure sensitive adhesive element being by nature more adherent to said thin, flat porous material than to hair; whereby said pressure sensitive adhesive element may be used to attach the flexible sheet firmly, but releasably, to the hair of the head of a person adjacent to the portion of hair which is to be chemically treated, so that said adhesive will adhere to said porous material more strongly than to the hair when the sheet is removed from the head after use.

2. The device of claim 1 wherein said porous material is substantially completely coincident with said flexible polymeric strip.

3. The device of claim 1 wherein said combined liquid-impermeable material and porous strip are of a weight such that when said adhesive element is pressed against the hair, and hair is placed on said liquid-impermeable material and treated with moist hair treating agent that the adhesive element does not slip.

4. The device of claim 1 wherein said adhesive element is of such a strength that when said adhesive element is pressed against the hair, that the combined flexible sheet and hair treated with moist hair treating agent will not cause the adhesive to slip.

5. The device of claim 4 wherein said adhesive has a tack of from about 3 pounds per square inch to about 14 pounds per square inch.

6. The device of claim 1 wherein said porous material is air permeable, and is selected from the group consisting of micro-porous, semi-porous and porous materials.

7. The device of claim 6 wherein said porous material is selected from the group consisting of paper, fabric, plastic, and mixtures thereof.

8. The device of claim 7 wherein said porous material is porous bond paper ranging from about 4 pound stock to about 30 pound stock.

9. The device of claim 7 wherein said porous material is fabric based materials, are selected from natural materials and from synthetic materials.

10. The device of claim 7 wherein said porous material is micro-porous air permeable material.

11. The device of claim 1 wherein said liquid-impermeable polymeric material is a thin coating on said surface of said first side of said porous strip.

12. The device of claim 1 wherein said liquid-impermeable material is water and chemical resistant and inert to moist hair treating agents.

13. The device of claim 1 wherein said liquid-impermeable material is a thin layer which is bonded to said surface of said first side of said porous strip.

14. The device of claim 1 wherein said liquid-impermeable material is a thin layer which is mechanically connected to said surface of said first side of said porous strip.

15. The device of claim 1 wherein said adhesive is a tape located directly on the porous surface.

16. The device of claim 15 wherein said tape is a two sided tape, with one side of the tape securely fastened to the second surface of said porous material, and the other side of the tape provides an adhesive for adhering the sheet to the hair.

17. The device of claim 1 wherein said adhesive is applied in a strip to said second surface of said porous material adjacent to or slightly inwardly of the first end of the first surface which is to be adhered to the hair, and adjacent to the portion of hair which is to be treated, and said adhesive extends substantially across the entire width of the first end of the flexible sheet.

18. A package in which the flexible sheets of claim 1 are stacked with the pressure sensitive adhesive of a first flexible sheet adhered to a backer sheet, and then with the pressure sensitive adhesive of a second sheet adhered to the liquid-impermeable surface of said first sheet, and so on, to provide a stack of readily accessible, easily removed sheets.

19. The device of claim 1 wherein an easily removable release strip is placed over the adhesive portion of each flexible sheet.

20. The device of claim 1 wherein said thin, flexible strip of material and said porous material are a single combined unit having a first liquid-impermeable side and a second porous side, the pressure sensitive adhesive element being adhered to said porous side of said combined unit.

21. The device of claim 20 wherein said unitary flexible sheet is micro-porous air permeable material.

22. The method of using the sheet of claim 1 wherein, with no up front preparation of the sheet, a colorist places the first end of the sheet with the adhesive element on the hair and then presses firmly on the liquid-impermeable surface to cause the adhesive element to firmly adhere it in place against the underlying hair, and then, weaves the desired amount of hair out and over the face of the liquid-impermeable surface, followed by the treatment of the desired portion of the hair on the liquid-impermeable surface with a wet hair treating agent, all while the liquid-impermeable second surface prevents any moisture or hair treating agents from bleeding through the sheet.

23. The method of claim 22 wherein, after the hair on the liquid-impermeable surface is treated and wetted, the colorist then bends said upper surface of said second end of said liquid-impermeable surface into contact with said upper surface of said first end of said liquid-impermeable surface, and then presses the two ends together so that the sheet forms, by hydrostatic adhesion, an open, stable, loop, in a manner such that the wetted hair remains firmly adhered to the surface of the liquid-impermeable second surface due to the moisture of the wet hair treating agent, so that the resulting open loop allows the treated hair to be open to ambient air so that full oxidation of the hair treating agents can take place during the process, when the second end is bent towards, and into contact with the first end to form and maintain the open loop as the sheet maintains its body during subsequent processing, and which open loop also allows the colorist to view the progress of the hair treating process without the need to open the looped sheet.

24. The method of claim 23 wherein, the adhesive of each flexible sheet is placed in overlapping contact with a portion of the adhesive of an adjacent sheet to form a series of adhered sheets, so that when the hair treating process is to be terminated all that is required is for the colorist to pull a single sheet, whereby the series of all of the adjacent overlapping adhered sheets are also removed.

25. The method of claim 22 wherein, in order to treat longer strands of hair, a plurality of sheets are joined together by taking a first sheet, and adhering the adhesive element of a second sheet to the liquid-impermeable surface of the first sheet, and so on, until a strip of the desired length is constructed.

* * * * *